US005359736A

United States Patent [19]

Olivier

[11] Patent Number: 5,359,736

[45] Date of Patent: Nov. 1, 1994

[54] SPRAY MEANS FOR A TOILET PEDESTAL

[75] Inventor: Gerard J. Olivier, Perth, Australia

[73] Assignee: Colivier Pty Ltd., Australia

[21] Appl. No.: 50,403

[22] PCT Filed: Nov. 15, 1991

[86] PCT No.: PCT/AU91/00523

§ 371 Date: May 17, 1993

§ 102(e) Date: May 17, 1993

[87] PCT Pub. No.: WO92/00851

PCT Pub. Date: May 29, 1992

[30] Foreign Application Priority Data

Nov. 16, 1990 [AU] Australia ..... PK 3392

[51] Int. Cl.[5] ..... A61H 35/00

[52] U.S. Cl. ..... 4/448; 4/443; 4/420.2; 4/420.4

[58] Field of Search ..... 4/443, 444, 445, 446, 4/447, 448, 420, 420.1, 420.2, 420.3, 420.4, 420.5, 615

[56] References Cited

U.S. PATENT DOCUMENTS

| | | | |
|---|---|---|---|
| 1,521,892 | 1/1925 | Koppin . | |
| 1,866,930 | 7/1932 | Guidetti et al. . | |
| 2,344,561 | 3/1944 | Popil . | |
| 3,605,124 | 9/1971 | Marcard et al. | 9/8 |
| 3,662,407 | 5/1972 | Colucci . | |
| 4,205,402 | 6/1980 | Miller | 4/448 |
| 4,334,329 | 6/1982 | Miyanaga | 4/443 |
| 4,406,025 | 9/1983 | Huck et al. | 4/443 |
| 4,616,368 | 10/1986 | Nagai et al. | 4/443 |
| 4,642,820 | 2/1987 | Boring, Jr. | 4/420.4 |

FOREIGN PATENT DOCUMENTS

| | | | |
|---|---|---|---|
| 51982 | 5/1982 | European Pat. Off. . | |
| 3804614 | 8/1989 | Germany | 4/448 |
| 2014210 | 8/1979 | United Kingdom . | |

*Primary Examiner*—Henry J. Recla
*Assistant Examiner*—Gregory M. Vidovich
*Attorney, Agent, or Firm*—Merchant, Gould, Smith, Edell, Welter & Schmidt

[57] ABSTRACT

A bidet device useable with a toilet has a nozzle (82) which supplies water in an accurate confined spray to the anal or genital area followed by air blown through the same nozzle so as to dry the wetted areas. Both water and air are electrically heated in unit (12) under thermostatic control. A hand grip (60) is used to slide spray conduit (62) and nozzle (82) from a storage position under the lop of the toilet bowl to an appropriate longitudinal position. Switch (52) is then used to control a low voltage circuit which energizes solenoid valves for the alternate supply of water and air. The unit will not operate unless both microswitch (80) [activated by cam (78)] and a pressure switch responding to the user's weight, are closed. In alternative arrangements the spray assembly is carried on an arm turning on a vertical pivot attached to the toilet pedestal or it forms part of a hand-held wand having no attachment to the toilet pedestal.

8 Claims, 7 Drawing Sheets

SPRAY MEANS FOR A TOILET PEDESTAL

FIELD OF THE INVENTION

The present invention relates to a spray means for a toilet pedestal particularly, although not exclusively, envisaged for use as an alternative to toilet paper used in water closets (generally referred to as "toilets").

More particularly, the present invention relates to a bidet attachment for a toilet to allow cleaning and drying of a person's genital area and anus.

DISCUSSION OF THE PRIOR ART

In-general, a person using a toilet employs toilet paper to clean his/her anus and/or genital area after using the toilet. The toilet paper must be periodically replenished and the toilet paper must be readily biodegradable in a sewerage system to which the toilet is connected.

It is known to provide a bidet for use in washing the person's anus and/or genital area after use of the toilet. Such bidets comprise, a pedestal, a cistern and a hot water system from which water fills the pedestal. The bidets operate by completely filling with water which uses about 10–15 liters of water which is inappropriate where water must be conserved. The bidet must be located adjacent a toilet and be readily accessible to a user of the toilet. Where the user has limited mobility, such as, in the case of physically handicapped people, it is generally not feasible to move the person from the toilet to the bidet to perform the washing function. Accordingly, such washing is generally performed by an aide to the handicapped person. Also, the bidet requires the use of a towel to dry the person's anus and/or genital area after use of the bidet. Further, the hot water system required by the bidet adds to the expense of the bidet installation. Still further, the conventional bidet takes up valuable space.

Various bidet attachments for toilets have been proposed in the past. The prior art bidet attachments fall generally into the broad categories of having spray nozzles that (a) pivot about vertical or (b) horizontal axes and (c) are disposed for movement fore and aft or (d) transverse of a pedestal of the toilet. Spray nozzles which pivot about horizontal axes (category (b)) have a disadvantage in that a spray of water from the spray nozzle tends to be directed to a focal point irrespective of the angle of disposition of the spray nozzle. In order to enable cleaning of both anal and genital areas the spray nozzle must be at a relatively large distance from these areas. Hence, its effective operation is affected by variations in water pressure and difficulty in achieving accurate delivery of a spray of the water to said areas. See, for example, U.S. Pat. No. 4062072 by A. B. Roberts UK Patent Application No. 2142054 by Ina Seito Company Limited (Japan) and Australian Patent Application No. 80610/87 by J. Diaz and L. Diaz. These bidet attachments seem to be concerned with general washing of the entire anus and genital area and are not concerned with accuracy of confinement of spray. Therefore, they assume that drying will be with a towel and are not suited to drying by blowing with warm air because of the excessive amount of water used and the size of the wetted area. Whilst Roberts does disclose a hot air drying unit, separate to the bidet attachment, the unit directs air only generally at the area of the anus from a rear of the toilet pedestal and thus does not provide accurate drying to the anus, nor drying to the genital area. Also, the unit requires separate plumbing and mounting, which is inconvenient and more costly.

Bidet attachments of category (d) (transverse movement of the spray nozzle) have a disadvantage in that their movement is at right angles to the alignment of the anus and genital area. Hence, category (d) bidet attachments are only suited to application of broadly directed sprays of water for cleaning the anus and genital area simultaneously. Due to the amount of water used and the size of the wetted area such bidet attachments are not suited to drying by blowing with warm air. See for example, U.S. Patent No. 4642820 by G. E. Boring and U.S. Pat. No. 4334329 by F. H. Miyanaga. Both of these patented inventions have a further disadvantage in that controls for the spray nozzle are located behind a user of the toilet and so are difficult to manipulate.

It is preferred to have a bidet attachment which falls into categories (a) and (c) since this provides the most accurate application of water to the anus and/or the genital area at the choice of the user and allows for use of relatively small amounts of water over relatively small areas. See, for example, U.S. Pat. No. 4406025 by L. F. Huck and U.S. Pat. No. 1,521,892 by H. S. Koppin. However, neither of these discloses passing air through the spray nozzle for drying the anus and genital area, nor valves necessary to enable use of the spray nozzle for carrying both water and air. Also, they are entirely silent as to the problems to be overcome in such application of air for drying the anus and genital area.

It is thus preferable to provide a bidet attachment, capable of use in cleaning a person's anus and/or genital area, which can be attached to a toilet pedestal and can be hand operated. The bidet attachment is thus available for self use and for use by aides to people unable to use the bidet attachment themselves. It is also preferred that the spray means be capable of drying the person's anus and/or genital area once cleaning is completed.

SUMMARY OF THE INVENTION

Therefore, the present invention provides a spray means for a toilet pedestal, the spray means being capable of fitting to a toilet pedestal and capable of hand operation to clean and dry a user's anus and/or genital area.

In the broadest form of the invention the spray means is used in association with a toilet pedestal but need not be attached to the toilet pedestal.

In accordance with one aspect of the present invention there is provided a spray means for use in cleaning and drying a person's anus and genital area, the spray means comprising:

a liquid supply means for supplying liquid under pressure;

a gas supply means for supplying gas under pressure;

a spray assembly for spraying the liquid and the gas as the anus and the genital area;

valve means connecting the liquid and gas supply means to the spray assembly; and, control means operatively associated with the valve means for separately supplying liquid or gas to the spray assembly but not both simultaneously;

whereby, in use, the liquid can be directed to clean the anus and genital area and the gas can be directed to dry the anus and genital area via the spray assembly.

The spray assembly is in a form chosen from a set including a hand held wand having no attachment to the toilet pedestal; a wand guided to move fore and aft of the toilet pedestal; and a wand pivotably attached to a side of the toilet pedestal for pivoting fore and aft. The latter two forms are referred to as "bidet attachments for toilets".

The spray means also has heater means for heating liquid from the liquid supply means and gas from the gas supply means. The heater means heats the liquid to a temperature such that when the liquid contacts the person's skin the person is not scalded, typically less than about 38° C. Also, the heater means heats the gas to a temperature such that the gas is at about 90° C. when it exhausts from the spray assembly and thus about 45° C. when the gas contacts the person's wetted skin. The temperature loss is due to mixing of the exhausted air with ambient air between the spray assembly and the skin and air turbulence caused by the exhausting spray of air.

Preferably, where the wand is attached to the toilet pedestal, it is moveable between a storage position, whereby a spray nozzle of the wand is disposed for cleaning by water released from a cistern of the toilet, and an operational position, whereby, the spray nozzle is locatable underneath the user's anus and genital area.

Preferably, the control means includes interrupt means for preventing operation of the valve means when the spray assembly is between the storage and operational positions and to allow operation of the valve means when the spray means is in the storage and operational position.

Typically, the liquid supply means includes a pump connected to a tank of liquid; or a tank supplied by mains liquid via a float valve; or a mains isolator designed to prevent back flow of liquid into the mains from the liquid supply means.

Typically, the gas supply means includes a gas compressor which may conveniently be coupled to a gas reservoir.

In accordance with another aspect of the present invention there is provided a toilet pedestal having a spray means attached to it for cleaning and drying a person's arms and genital area, the spray means being as defined hereinabove.

BRIEF DESCRIPTION OF THE DRAWINGS

Five embodiments, being examples only, of the present invention will now be described, with reference to the accompanying drawings in which.

DESCRIPTION OF THE PREFERRED EMBODIMENTS

Figure 1:
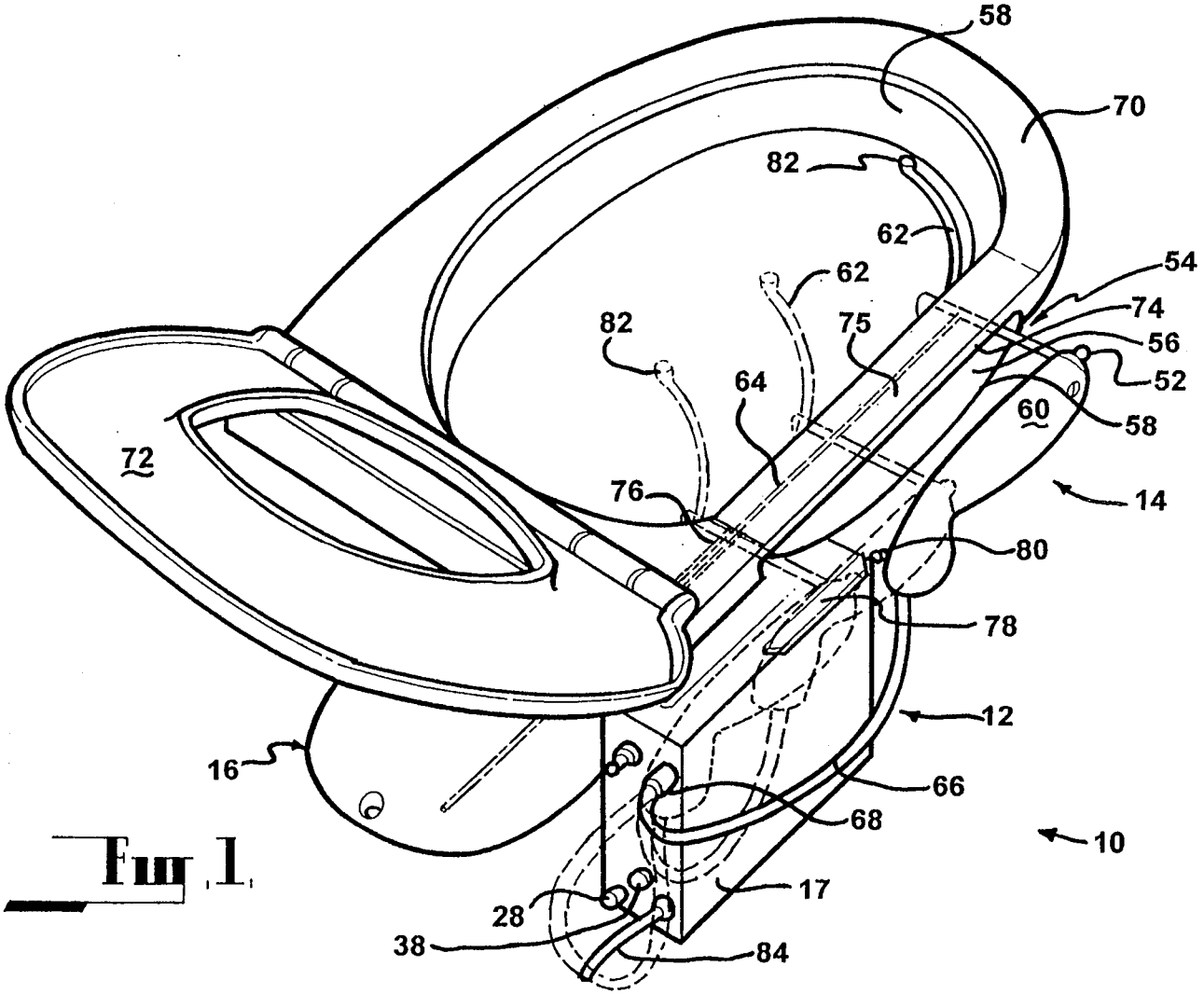
FIG. 1 is a perspective view, seen from above, of a bidet attachment having a base unit and a spray assembly according to one embodiment of the present invention, in the form of a wand, shown coupled to and guided along a toilet pedestal.

In FIG. 1 there is shown spray means 10 comprising a base unit 12 and a spray assembly 14 according to a first embodiment of the present invention. The spray assembly 14 is shown attached to a toilet pedestal 16 and the base unit 12 is contained in a housing 17.

Figure 2:
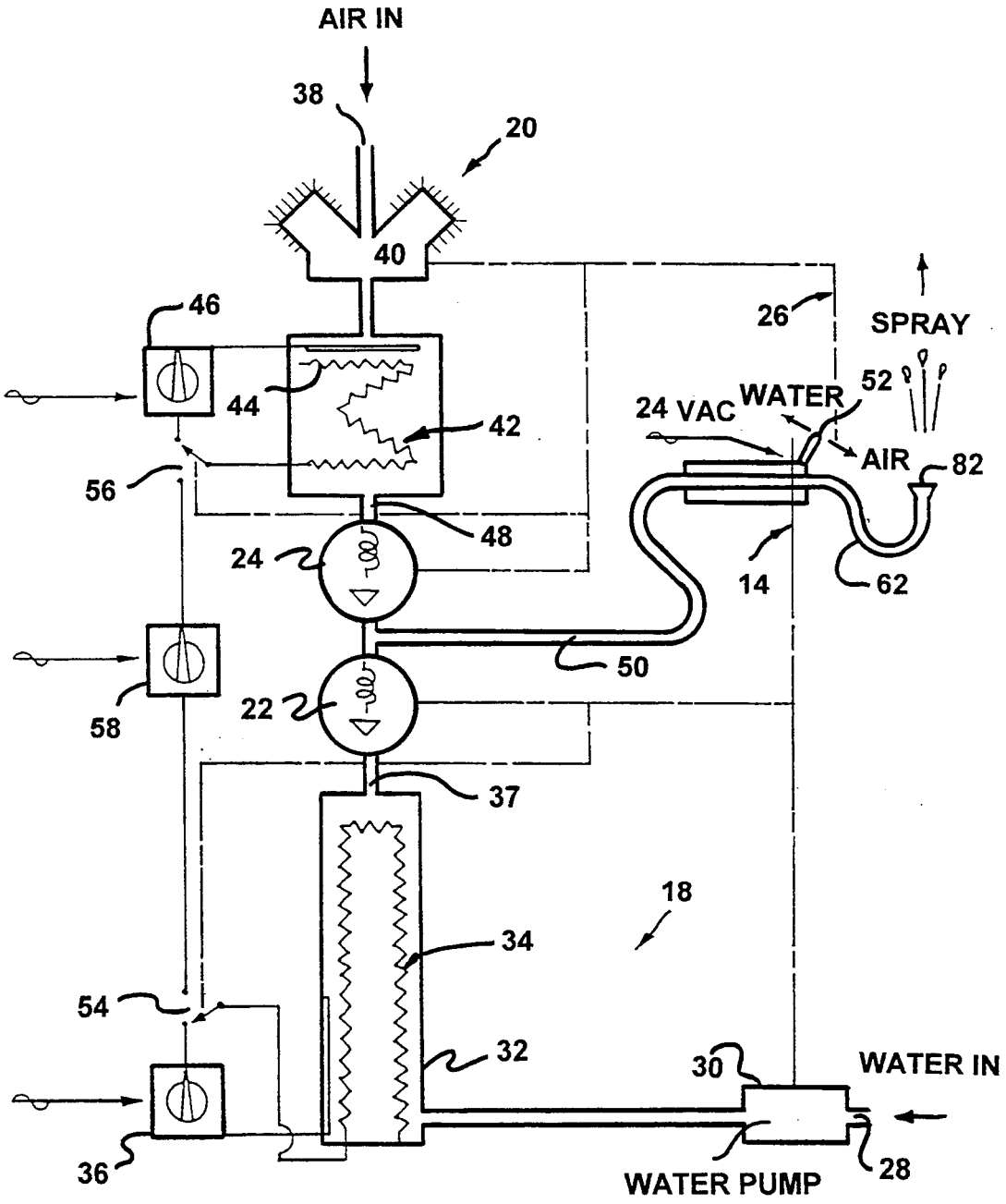
FIG. 2 is a schematic diagram of fluidic circuits of the bidet attachment of FIG. 1.

As shown in FIG. 2 the base unit 12 comprises a liquid supply means in the form of a water supply unit 18, a gas supply means in the form of an air supply unit 20, valve means in the form of two solenoid valves 22 and 24 and a control means in the form of a control unit 26. The water supply unit 18 includes inlet 28 coupled to a supply of water. Where the supply of water is a low pressure a water pump 30 is provided to supply the water at pressure to a tank 32. Where the water at the inlet 28 is at mains pressure the inlet may be connected to a mains isolator for inhibiting flow of the water back into the mains or a holding tank whose water level is controlled by a float valve. The tank 32 is provided with a heating element 34 controlled by a thermostat 36 for heating the water in the tank 32 to a predetermined temperature, such as, for example, between 35 and 45° C., for instance about 38° C. An outlet 37 of the tank 32 is connected to the solenoid valve 22.

The air supply unit 20 includes an air inlet 38 to an air compressor 40. Typically, the air compressor 40 is a double acting compressor for providing compressed air at about 62 kpa (9 PSI). The air compressor 40 is connected to a heat exchanger 42 in the form of a mass of metal (such as aluminum) having a heating element 44 controlled by a thermostat 46. The thermostat 46 is set to heat the air to in excess of 90° C, for reasons explained hereinafter. An outlet 48 of the heat exchanger 42 is connected to the solenoid valve 24.

The two solenoid valves 22 and 24 are connected to a common line 50 connected to the spray assembly 14.

The control unit 26 includes a center-off toggle switch 52, located on the spray assembly 14, for hand manipulation. The switch 52 is electrically connected to relays 54 and 56 for switching the thermostats 36 and 46 for the heating elements 34 and 44, respectively, out of circuit, and switching a diac-triac controller 58 into circuit in their place. The diac-triac controller 58 is set to provide boosted heating to the tank 32 and the heat exchanger 42 when water and air, respectively, are flowing through them. The switch 52 is also electrically connected to the solenoid valves 22 and 24 so that movement of the switch 52 to a position marked "water" causes energization of the solenoid valve 22 and movement to a position marked "air" causes energization of the solenoid valve 24. Whilst the switch 52 is in an "off" position the heating elements 34 and 44 are controlled by the thermostats 36 and 46, respectively, to preheat the water in the tank 32 and the air in the heat exchanger 42. The control unit 26 also has a pressure switch (not shown) connected in series with switch 52 to inhibit operation of the solenoid valves 22 and 24 unless a person is sitting on toilet pedestal 16. The pressure switch is intended to avoid accidental operation of the base unit 12. Typically, the control unit 26 operates at 24 Volts AC and the heating elements 34 and 44 operate at mains voltage AC. Relatively low voltage operation of the control unit 26 is preferred so as to reduce the likelihood of electrocution in the event of short circuiting to ground via the body of a person using the spray means 10.

The spray assembly 14, as shown in FIG. 1, is in the form of a wand attached to and guided along a side 56 of a lip 58 of the toilet pedestal 16. The wand 62 comprises a hand grip 60, a spray conduit 62, a guide rod 64 and an umbilical cord 66. The hand grip 60 carries the switch 52 and receives one end of the umbilical cord 66. The other end of the umbilical cord 66 is connected via a quick release coupling 68 to the common line 50 and control unit 26 of the base unit 12 via a connector on an outside of the housing 17. The umbilical cord 66 has a fluid hose and control cables in it. The fluid hose is connected to a conduit in the hand grip 60 Eo the spray conduit 62. The control cables of the umbilical cord 66 are connected to the switch 52. The guide rod 64 depends from the spray conduit 62 and is disposed fore and aft of the toilet pedestal 16. The spray conduit 62 is shaped to conform to the shape of the interior of the toilet pedestal 16 underneath the lip 58. The spray conduit 62 extends substantially perpendicularly from a side of the hand grip 60.

The spray assembly 14 is guided along the toilet pedestal 16 by a guide base 70 attached between the toilet pedestal 16 and a toilet seat 72. The guide base 70 is typically made from plastics material and substantially conforms to the shape of the toilet pedestal 16 when viewed in plan. The guide base 70 is formed on its undersurface to co-operate with the upper edge of side 56 of the lip 58 of the pedestal 16 to form a slot which allows movement of the spray conduit along the fore and aft axis of the pedestal. A spray conduit 62 extends across the slot to extend to each side thereof. In addition the portion of the guide base rearward of the rebate is formed with a rearwardly extending axial passageway 76 which accommodates the guide rod 64 and permits axial movement of the guide rod 64 as the spray conduit 62 is caused to be moved between its end positions within the slot.

An interrupt means in the form of a cam 78 is disposed from the guide base 70 for actuating a microswitch 80 located on the hand grip 60. The cam 78 causes actuation of the microswitch 80 when the spray conduit 62 is moved from a storage position with its spray nozzle 82 disposed under the lip 58 of the toilet pedestal to an operational position whereby the spray nozzle 82 is disposable underneath the anus and genital area of the user. Actuation of the microswitch 80 enables electrical connection of the switch 52 to the remainder of the control unit 26. Hence the solenoid valves 22 and 24 can not be actuated unless the spray conduit 62 is in the operational position. When in the storage position water discharged from a cistern connected to the toilet pedestal 16, washes over the spray conduit 62 and the spray nozzle 82 to clean same.

In use, the spray means 10 according to the present embodiment is installed by mounting the guide base 70 upon the lip 58 of the toilet pedestal 16 under the toilet seat 72. The guide rod 64 of the spray assembly 14 is inserted into the hole 76 and the spray conduit 62 disposed over the lip 58 and into the interior of the toilet pedestal 16. A beam 75 is then fixed in place over the spray conduit 62 to form the slot 74. The quick release coupling 68 of the umbilical cord 66 is attached to the coupling of the housing 17. The housing 17 is connected to a supply of mains voltage electricity via a mains cord 84 and the Water inlet 28 is connected to a supply of water. Then the pressure switch, located in the guide base 70, is connected into the control unit 26.

A person wishing to use the toilet lowers the toilet seat 72 and sits on it to activate the pressure switch. The pressure switch activates the control unit 26 for preheating the water and heat exchanger 42. Once the person has finished using the toilet the person can clean his or herself by grasping the hand grip 60 and drawing it aftwardly whilst remaining seated on the toilet seat 72. Once the spray nozzle 82 is in the operational zone the microswitch 80 is actuated by the cam 78 to electrically connect the switch 52 to the remainder of the control unit 26. Toggling of the switch toward the "water" position then activates the solenoid valve 22 and the water pump 30 (if installed) to supply water from the water supply via the inlet 28 to the tank 32. The water in the tank 32 is heated and passes out via the outlet 37 to the solenoid valve 22 and to the common line 50. The heated water then flows out of the coupling and into the umbilical cord 66, through the hand grip 60, through the spray conduit 62 and out of the spray nozzle 82 for spraying the person's anus and genital area. With the switch 52 toggled to the "water" position the relay 54 disconnects the thermostat 36 and connects the diac-triac 58 to the heating element 34 to provide more accurate heating of water as it flows through the tank 32.

Once the person is satisfied that he or she is sufficiently clean the switch 52 is toggled to the "air" position to activate the solenoid valve 24 and the air compressor 40 to supply air to the heat exchanger 42 via the inlet 38. The air is heated in the heat exchanger 42 and passes out via the outlet 48 to the solenoid valve 24 and the common line 50. The heated air then flows along the same path as the water had previously and contacts the person's skin in the same areas to effect drying. In the "air" position the relay 56 disconnects the thermostat 46 and connects the diactriac 58 to the heating elements 44 to provide more accurate heating to the heat exchanger 42 as the air flows through it.

It has been discovered that the temperature of the air exhausting from the spray nozzle should be in excess of 90° C. so as to achieve air at about 45° C. at the surface of the person's skin. This is because the spray of exhausting air mixes with surrounding air. The temperature of the mixture is typically about half that of the exhausting air. Such a problem does not occur with the water since there is not similar mixing and the water has a much higher thermal inertia than the air since it is a liquid and not a gas.

When the person is satisfied that they are sufficiently dry the switch 52 is toggled to the "off" position to de-energize the solenoid valve 24 and the air compressor 40. The wand 54 is then pushed forward so that the microswitch 80 is deactivated and the spray nozzle 82 returned to the storage position. Flushing of the cistern then cleans the spray conduit 62 and the spray nozzle 82.

The base unit 12 may include adjusters for the thermostats 36 and 46 to take into account the ambient temperature. The adjusters could be manually operated or automatic.

The fluid lines of the spray means 10 from the outlets 37 and 48 to the spray nozzle 82 could be lined with heat insulative material to avoid temperature loss due to passage of fluid in the lines.

The heating elements could be stationed in the spray assembly 14 to assist in overcoming the problem of heat loss in the fluid lines. Typically, the heating elements in such a case would be operated at low voltage, say about 1.12 volts, and high current, say about 62 amps to lessen the risk of electrocution. The heating elements could take the form of a heavy gauge copper conductor, of about 5 mm diameter, running along the conduit 62 from its connection with the guide rod 64 to the spray nozzle 82, and electrically connected to the spray nozzle 82. The conduit 62 then forms the return path for the flow of electricity back to the guide rod 64. Two further conductors then connect, one to the first conductor and the other to the conduit 62 at the guide rod 64, and run along the guide rod 64 and into the base unit 12. Flow of electricity along the conduit 62 causes it to heat up and thus heat the water and air flowing through it. Preferably, a higher starting voltage may be used to overcome thermal inertia of the conduit 62 once the control unit 26 is activated by the pressure switch.

Figure 3:
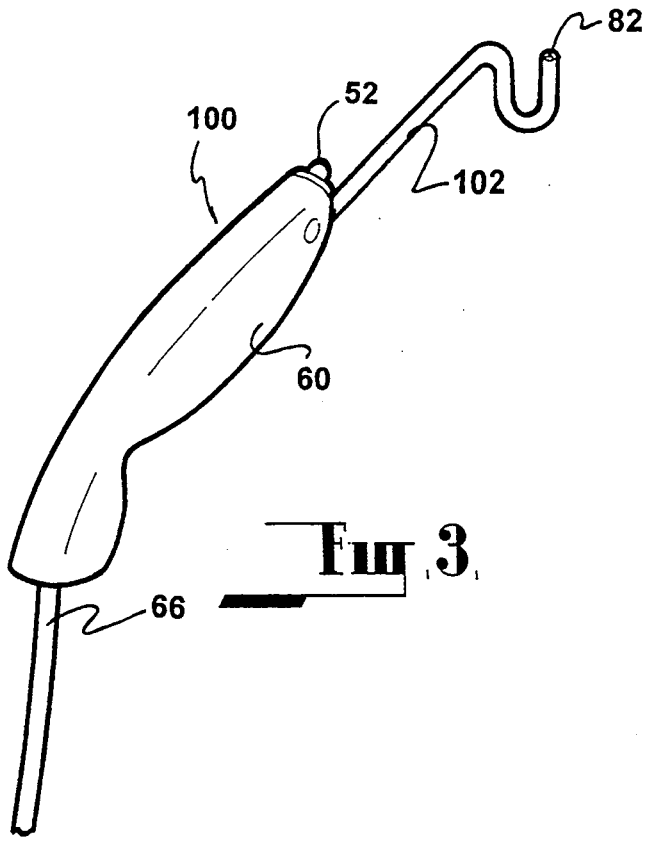
FIG. 3 is a perspective view, seen from above, of a spray assembly according to another embodiment of the present invention, in the form of a hand held wand, for use with the base unit shown in FIG. 1.

In FIG. 3 there is shown a spray assembly 100 according to another embodiment of the present invention. The spray assembly 100 is similar to the spray assembly 14 and like numerals denote like parts. The spray assembly 100 is in the form of hand held wand having no attachment to the toilet pedestal 16. The spray assembly 100 differs from the spray assembly 14 in that it has a spray conduit 102 which is substantially straight and depends in a lengthwise extending direction from the hand grip 60. Also, the spray conduit 102 has a crook, terminating at the spray nozzle 82, for avoiding touching the person's anus and genitals when in use.

Preferably, a cradle is fixed, such as by gluing, to the side of the toilet pedestal 16, or the housing 10, for carrying the spray assembly when not in use. Preferably, a pouch is provided for receiving and storing the spray assembly 100 when in transit.

In use, the umbilical cord 66 of the spray assembly 100 is connected to the housing in the same manner as the spray assembly 14. The switch 52 is operated in the same manner for spraying heated water and air out of the spray nozzle 82. The spray assembly 100 is used differently to the spray assembly 14 in that it can be freely hand manipulated to clean and dry the anus and genital area of the user.

Figure 4:
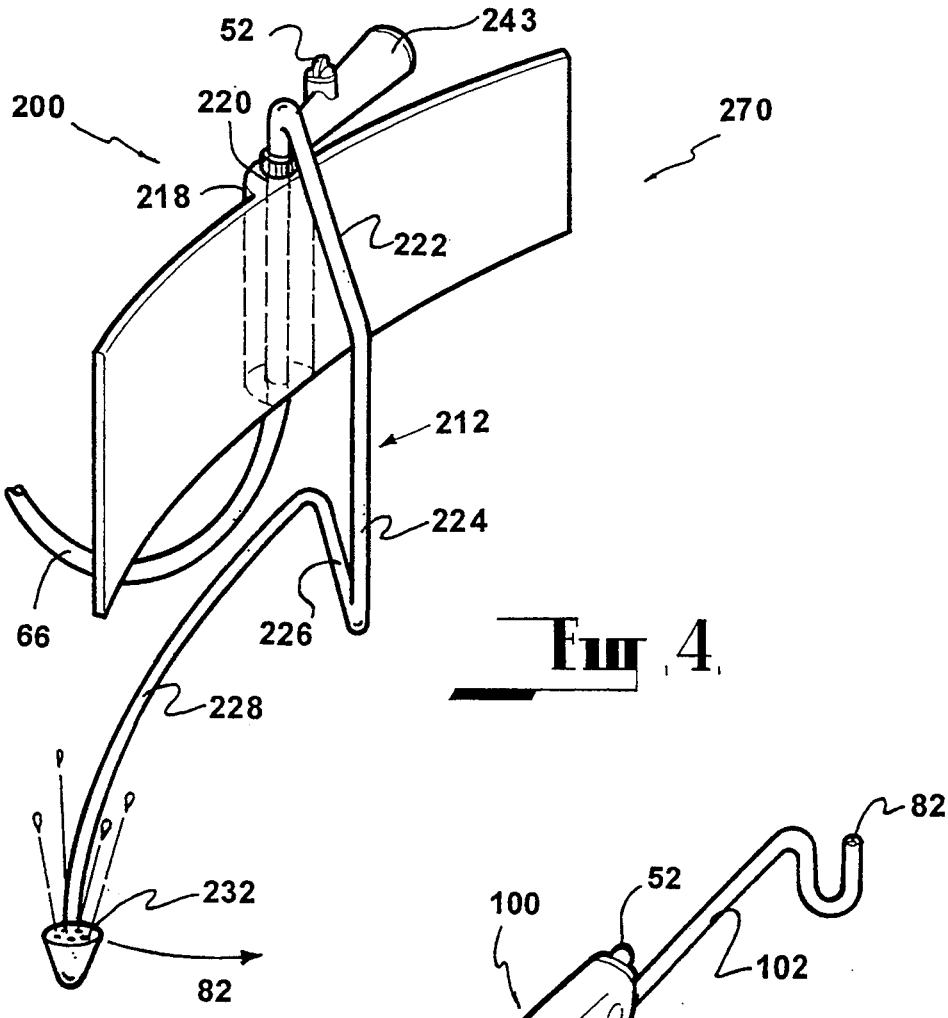
FIG. 4 is a perspective view, seen from above, of a spray assembly in accordance with yet another embodiment of the present invention, in the form of a wand pivotably mounted in a bracket.
Figure 5:
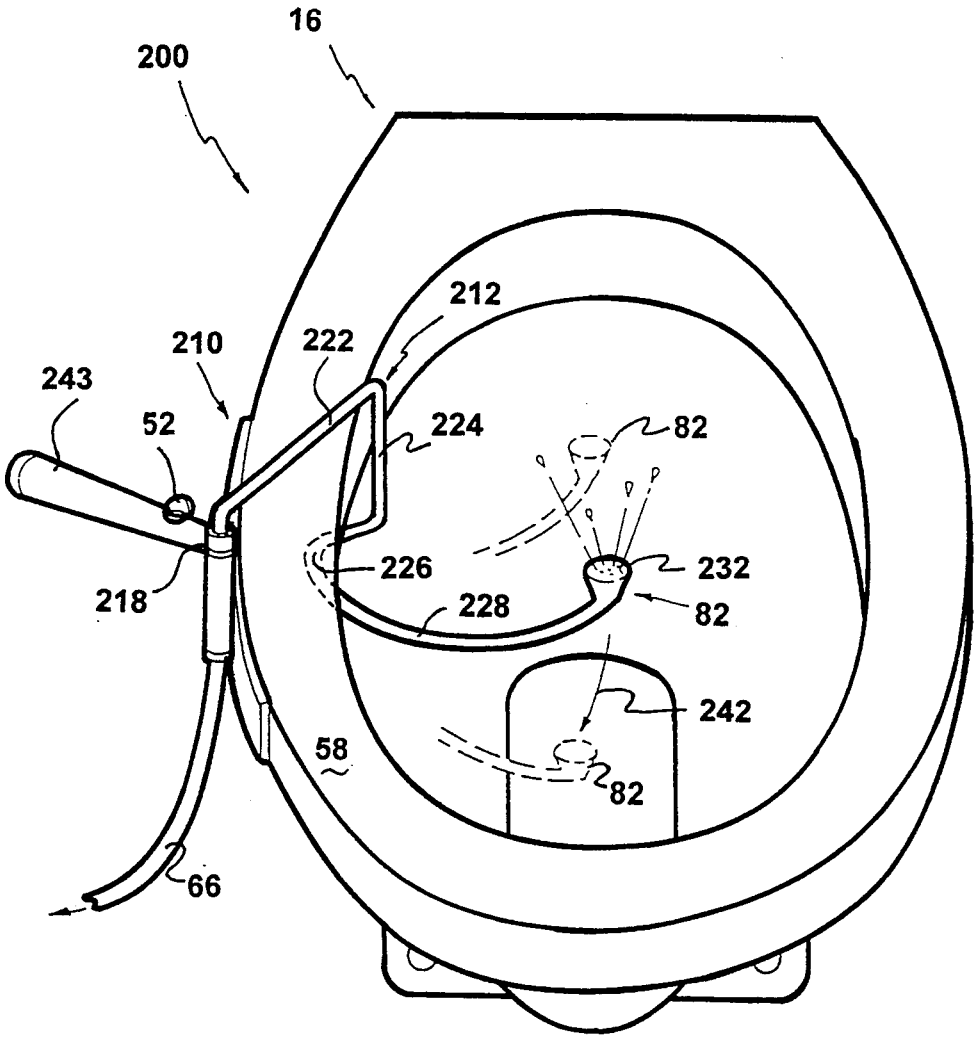
FIG. 5 is a perspective view, seen from above, of the spray assembly of FIG. 4 shown adhered by a bracket to a toilet pedestal.

In FIGS. 4 and 5 there is shown a spray assembly 200 according to yet another embodiment of the present invention. The spray assembly 200 is in the form of a wand pivotably attached to the side 56 of the toilet pedestal 16. The spray assembly 200 is similar to the spray assembly 14 and like numerals denote like parts. The spray assembly 200 comprises a bracket 210 and a spray conduit 212. The bracket 210 is typically curved for attaching, such as, by gluing, to the lip 58 of the toilet pedestal 16 as shown in FIG. 5. The bracket 210 includes a boss 218 disposed substantially at right angles to the curvature of the bracket 210.

As shown in FIGS. 4 and 5, the spray conduit 212 has a first portion 220 pivotably disposed within the boss 218. The spray conduit 212 has- a second portion 222 disposed substantially at right angles to the first portion 220, disposed upon the lip 58 and directed toward an interior of the toilet pedestal 16. The second portion 222 terminates at a third portion 224 which is disposed downwardly into the interior of the toilet pedestal 16 and substantially parallel to the first portion 220. The spray conduit 212 has a fourth portion 226 terminating the third portion 224. The fourth portion 226 is disposed underneath the lip 58. The spray conduit 212 also has a curved arm 228 extending from fourth portion 226. The arm 228 typically terminates at the spray nozzle 82 having a rose 232 designed to direct a spray of liquid, such as, for example, water upwardly from the spray nozzle 82.

Typically, the spray conduit 212 is made of a metal or plastics material and is relatively rigid. Preferably, the spray conduit 212 is a poor conductor of heat so as not to absorb heat from the heated water and air passing through it.

The spray conduit 212 is pivotable between the storage position and the operational position. During pivoting the spray nozzle 82 describes an arc 242 which represents an area proximate the person's anus and genital area at which area water and air can be sprayed upwardly.

The spray assembly 200 has a handle 243 for manipulation of the conduit 212 between the storage and operational positions. Typically, the handle 243 is substantially parallel to an axis drawn through the ends of the curved arm 228 of the spray conduit 212. The handle 243 includes the switch 52 for activating remainder of the control unit 26.

In use, the bracket 210 is typically glued to the lip 58 of the toilet pedestal 16. Fixing to the exterior of the toilet pedestal 16 is preferred since there is then less likelihood of the bracket 210 becoming soiled. Such fixing of the bracket 10 disposes the conduit 212 into the interior of the toilet pedestal 16. The spray assembly 200 is connected by the umbilical cord 66 to the base unit 12.

To operate the spray assembly 200 the handle 243 is grasped and the spray nozzle 82 of the spray conduit 212 pivoted from the storage position to the operational position whereat the handle 243 is pivoted back and forth to pivot the spray nozzle 82 back and forth beneath the users anus and genital area. Simultaneously, the switch 52 on the handle 243 is depressed to actuate the solenoid valves 22 and 24 as described hereinabove. The spray conduit 212 and the spray nozzle 82 are both cleaned when in the storage position when the toilet cistern is flushed.

It is envisaged that the conduit 212 could be made of stainless steel and/or could be chromium plated to resist corrosion and/or coated with cleanable insulative material.

Figure 6:
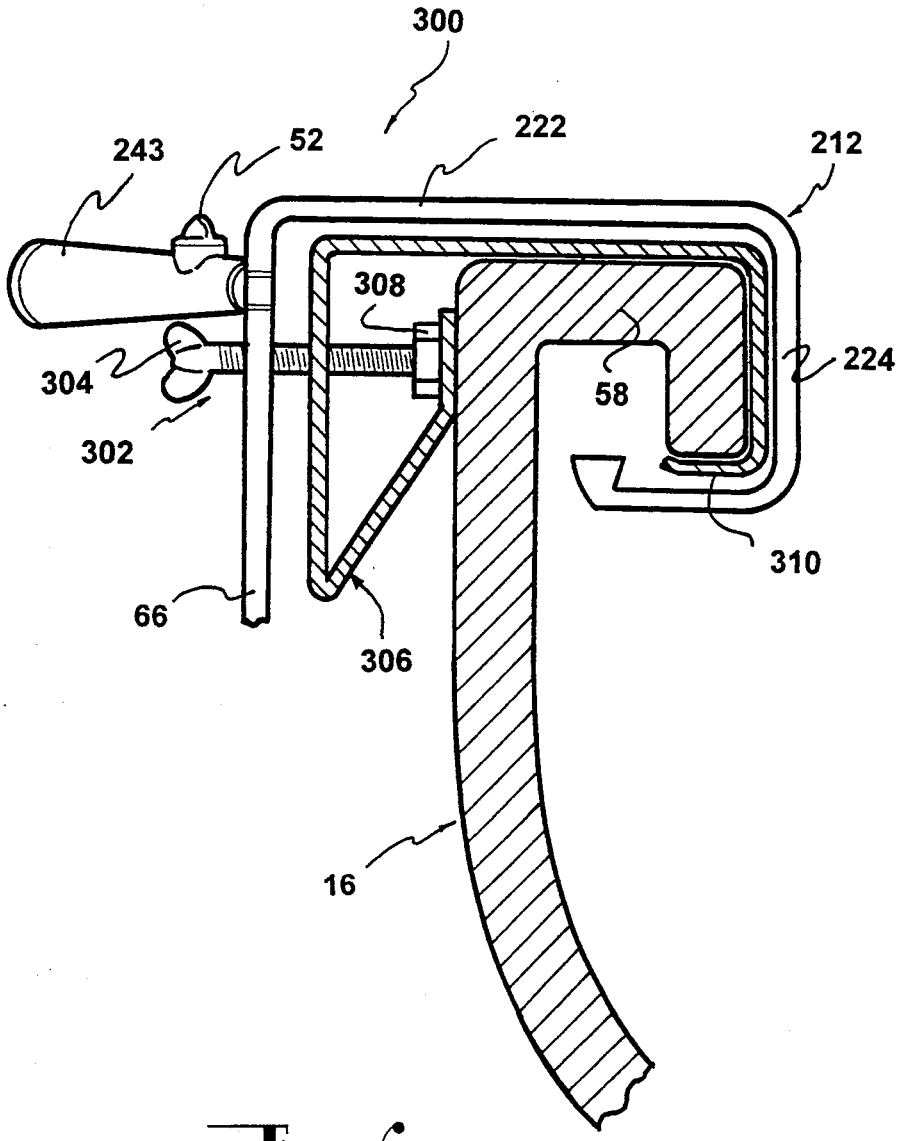
FIG. 6 is a part vertical cross sectional view of a spray assembly according to yet another embodiment of the present invention, in the form of a wand shown clamped by a bracket to a toilet pedestal; and, FIGS. 7 and 8 are, respectively, plan and side views of a spray assembly according to yet another embodiment of the present invention, in the form of a wand pivotable in a vertically disposed hole formed in a lip of a toilet pedestal.

In FIG. 6 there is shown a spray assembly 300 according to yet another embodiment of the present invention similar to the spray assembly 200 and like numerals denote like parts. The spray assembly 300 has a clump 302 for searing to the lip 58 of the toilet pedestal 16. The clamp 302 has a drive bolt 304 threadedly engaged with a bracket 306 shaped to fit over the lip 58. The drive bolt has a pad 308 for bearing against an outside of the lip 58. The bracket 302 has a cupped edge 310 for fitting underneath the lip 58 to resist the bracket 306 rising up off the lip 58.

In use, the spray assembly 300 is installed by fitting the cupped edge 310 under the lip 58 and threading the drive bolt 304 in the bracket 306 to force the pad against the lip 58. The handle 243 is then manipulated in the same manner as for that of the spray assembly 200.

Figure 7:
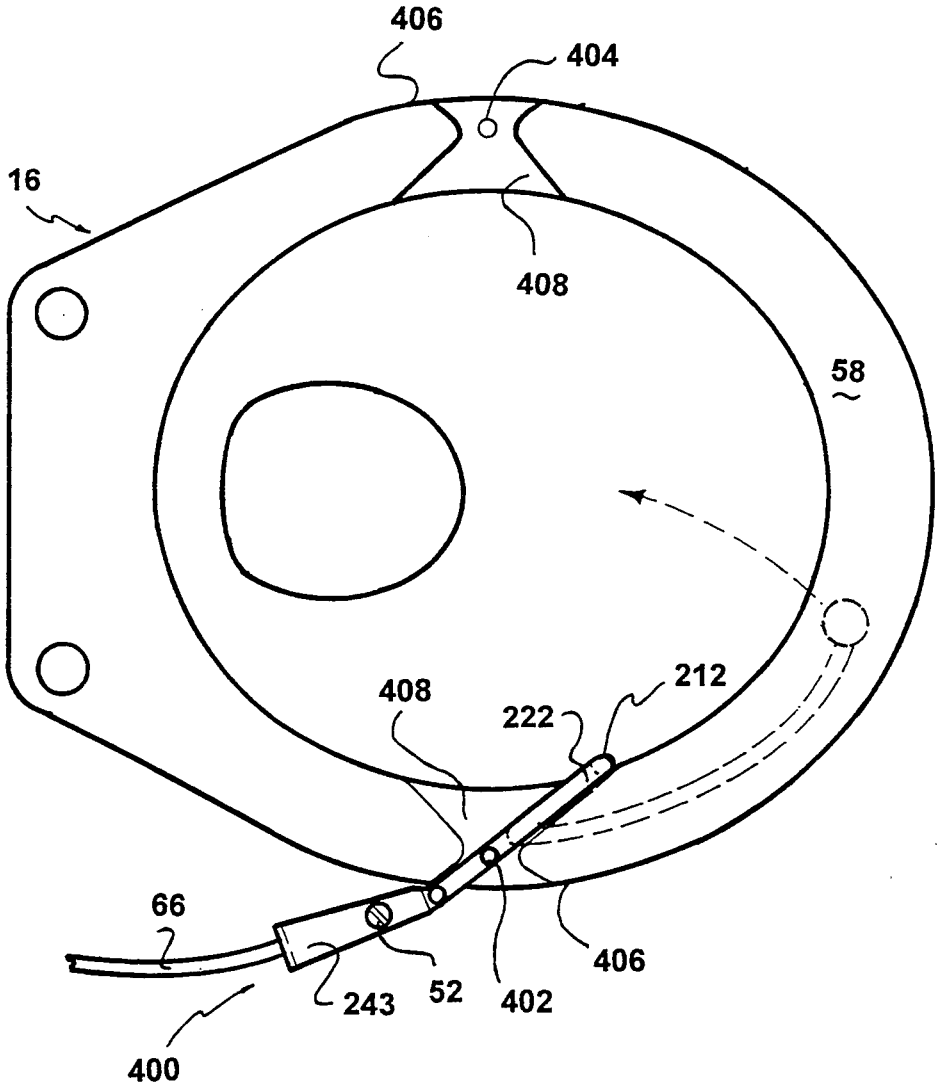
Figure 8:
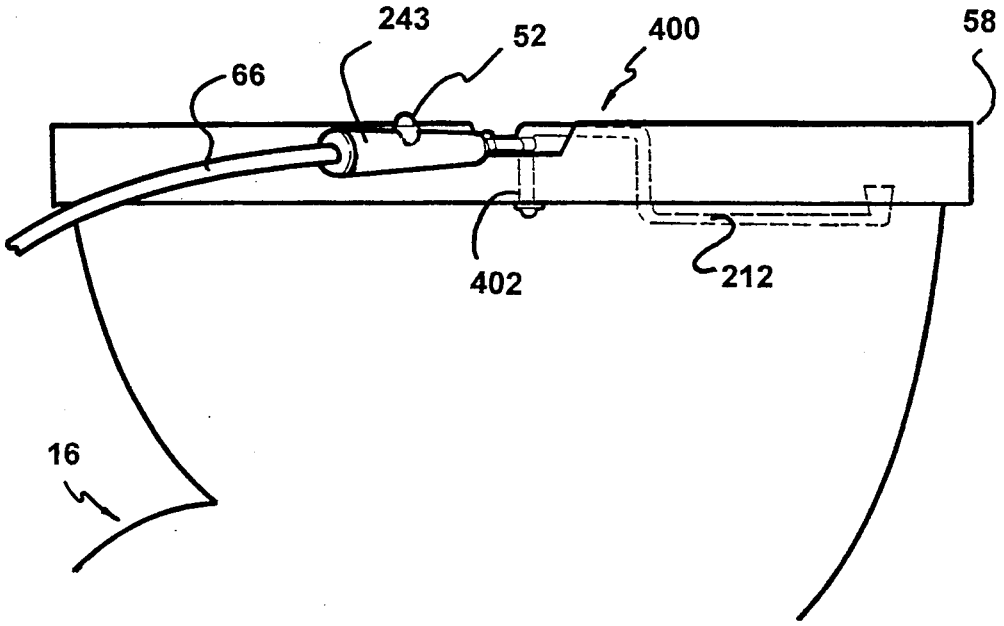

In FIGS. 7 and 8 there is shown a spray assembly 400 according to yet another embodiment of the present invention similar to the spray assembly 200 and like numerals denote like parts. The spray assembly 400 has a pivot post 402 disposed vertically downwardly from the second portion 222 of the spray conduit 212 proximate its juncture with the handle 52. The pivot post 402 is received in a vertically disposed hole 404 located proximate an outer edge 406 of the lip 58 of the toilet pedestal 16. A depression 408 is provided about the hole 404 extending to the interior of the toilet pedestal 16. Typically, the depression 408 is triangular when viewed in plan and has one apex located at the hole 404 and the other apices located at the interior of toilet pedestal 16. The depression 408 has a depth typically slightly greater than the thickness of the second portion 222 so that the second portion can pivot in the depression 408 without contacting an underside of the toilet seat 72.

Preferably, a hole 404 and depression 408 is located on opposite sides of the lip 58 as shown in FIG. 7, to allow for left handed and right handed installations.

In use, the spray assembly 400 is operated in identical manner with spray assembly 200.

The spray means for a toilet pedestal has advantages over the prior art in that it allows for retrofitting to a toilet pedestal and is operable to clean, with water, and dry, with warm air, the anus and genital area of a user.

The spray assembly 14,100,200,300,400 is moveable fore and aft underneath the anus and genital area to enable accurate application of heated water for cleaning thereof without over wetting of the anus and genital area. Since the air is sprayed out of the same spray nozzle 82 as the water the air can be accurately applied to dry the wetted areas. The spray nozzle 82 and the spray conduit 62 and 212 are stored underneath the lip 58 of the toilet pedestal 16 and so are cleaned by water flushed into the toilet pedestal 16 from a cistern connected thereto.

The spray assembly 14 has the advantage of cooperation with the cam 78 for inhibiting activation of the solenoid valves 22 and 24 unless the spray nozzle 82 is in the operational position. The spray assembly 100 has the advantage that it can be readily transported and coupled to any base unit 12. Hence, the spray assembly 100 serves as a personal hygiene device useable with any toilet having one of the base units 12. The spray assemblies 200 and 300 have the advantage that they can be easily applied to the lip 58 and pivot about a vertical axis outside the lip 58 thus reducing the amount of the spray assembly 200 and 300 prone to becoming soiled. The spray assembly 400 has the advantage that no modification to the toilet seat 72 or the attachment of the toilet seat 72 to the toilet pedestal 16 is necessary in order to avoid the spray conduit 212 contacting the underside of the toilet seat 72 or becoming jammed between the lip 58 and the toilet seat 72.

Modifications and variations such as would be apparent to a skilled addressee are deemed within the scope of the present invention. For example, the water supply unit 18 and the gas supply unit 20 could include large stores of water and compressed gas, respectively, for supplying a plurality of spray assemblies 14. Such an arrangement could be used in situations where a plurality of toilets are provided in close proximity, such as, for example, in public toilet facilities, blocks of apartments in multistory arrangement and the like.

I claim:

1. A spray attachment for a toilet pedestal having an upper peripheral rim defining front, rear and side edges comprising a guide base shaped and configured for mounting over said rim, said guide base further including a recess formed along a bottom edge thereof which defines a longitudinal slotted opening substantially parallel to a for and aft axis of the toilet pedestal between said bottom edge and one of said side outer edges, said attachment further including a housing adapted to be mounted to one side of said toilet pedestal, said housing having an inlet adapted to be connected to a water supply, said housing having a forced air source, therein a conduit means supported at one end thereof from said housing and extending from said housing and through said longitudinal slotted opening to be received within the pedestal and to be movable for at least a portion of its travel along said fore and aft axis of the pedestal, an upwardly directed outlet nozzle provided at an outer end of said conduit means and adapted to be located at a position below the lowermost portion of the body of an occupant of the pedestal, said conduit means being connected at its one end to a first end of a first conduit, said first conduit further comprising a second end having a first portion extending therefrom and connected to said inlet and a second portion extending from said second end of said first conduit and connected to said forced air source, a first valve provided in the first portion and a second valve provided in the second portion, a handle connected to said conduit means to facilitate manipulation of said conduit means by the occupant to enable said conduit means to be moved from a stored position wherein said nozzle is located adjacent an inner wall of the pedestal to a range of positions along said fore and aft axis below the anus and genitalia of the occupant, a control means operatively connected to said first and second valves to selectively open said first valve and said second valve when said conduit means is moved to said range of positions.

2. A spray attachment as claimed at claim 1 wherein said control means is provided on said handle.

3. A spray attachment as claimed at claim 1 wherein said control means further comprises means, operatively connected to said first and second valves, for selectively enabling the opening of said first and second valves only when said conduit means is located in said range of positions.

4. A spray attachment as claimed at claim 2 wherein said control means further comprises means, operatively connected to said first and second valves, for selectively enabling the opening of said first and second valves only when said conduit means is located in said range of positions.

5. A spray attachment as claimed at claim 1 wherein said first portion comprises a reservoir having a thermostatically operated heater therein.

6. A spray attachment as claimed at claim 1 wherein said second portion comprises an electrically operated heat exchanger.

7. A spray attachment as claimed at claim 1 comprising a control switch operatively mounted to said handle activated by the presence of an occupant on the to wherein said switch controls said spray attachment and is activated by the presence of said occupant on the toilet pedestal.

8. A spray attachment as claimed at claim 1 wherein said conduit means is slidably supported within said longitudinal slotted opening such that said conduit means is movable along said fore and aft axis from the stored position to the range of positions.

* * * * *

UNITED STATES PATENT AND TRADEMARK OFFICE

CERTIFICATE OF CORRECTION

PATENT NO. : 5,359,736

DATED : November 1, 1994

INVENTOR(S) : Gerald J. C. Olivier

It is certified that error appears in the above-identified patent and that said Letters Patent is hereby corrected as shown below:

On column 2, line 57, please delete "as" and substitute therefore --at--

On column 3, line 42, please delete "arms" and substitute therefore --anus--

On column 5, line 19, please delete "Eo" and substitute therefore --to--

On column 5, line 39, please delete "rebate" and substitute therefore --slot--

On column 6, line 5, please delete "Water" and substitute therefore --water--

On column 6, line 46, please delete "diactriac" and substitute therefore --diac-triac--

UNITED STATES PATENT AND TRADEMARK OFFICE

CERTIFICATE OF CORRECTION

PATENT NO. : 5,359,736

DATED : November 1, 1994

INVENTOR(S) : Gerald J. C. Olivier

It is certified that error appears in the above-indentified patent and that said Letters Patent is hereby corrected as shown below:

On column 11, line 9, (claim 7), please delete "activated by the presence of an occupant on the to" after the word "handle"

Signed and Sealed this

Seventh Day of February, 1995

*Attest:*

Bruce Lehman

BRUCE LEHMAN

*Attesting Officer*

*Commissioner of Patents and Trademarks*